US008601751B2

(12) United States Patent
Carter

(10) Patent No.: US 8,601,751 B2
(45) Date of Patent: Dec. 10, 2013

(54) CONCEALED SLIDING PARTITION TRACK AND INTEGRATED SUBTERRANEAN WATER REMOVAL SYSTEM

(76) Inventor: Benjamin Carter, Altamonte Springs, FL (US)

( * ) Notice: Subject to any disclaimer, the term of this patent is extended or adjusted under 35 U.S.C. 154(b) by 0 days.

(21) Appl. No.: 13/595,763

(22) Filed: Aug. 27, 2012

(65) Prior Publication Data

US 2013/0047515 A1 Feb. 28, 2013

Related U.S. Application Data

(60) Provisional application No. 61/527,279, filed on Aug. 25, 2011.

(51) Int. Cl.
*E02D 19/00* (2006.01)

(52) U.S. Cl.
USPC ..... 52/169.5; 52/243.1

(58) Field of Classification Search
USPC ..... 52/169.5, 243.1, 220.7, 302.1, 302.3
See application file for complete search history.

(56) References Cited

U.S. PATENT DOCUMENTS

| | | | | | |
|---|---|---|---|---|---|
| 2,355,803 | A * | 8/1944 | Hopewell | 160/33 |
| 2,955,521 | A * | 10/1960 | Kurek | 454/192 |
| 3,334,375 | A * | 8/1967 | Hubbard | 16/97 |
| 4,286,419 | A * | 9/1981 | Treffers | 52/39 |
| 5,022,454 | A * | 6/1991 | Kobayashi et al. | 160/202 |
| 5,272,839 | A * | 12/1993 | Karhu | 49/409 |
| 6,286,258 | B1 * | 9/2001 | Bischof et al. | 49/127 |

* cited by examiner

*Primary Examiner* — Basil Katcheves
(74) *Attorney, Agent, or Firm* — Daniel Law Offices, P.A.; Jason T. Daniel, Esq.

(57) ABSTRACT

A concealed sliding partition track and integrated subterranean water removal system includes an elongated generally U shaped main body having an angled top surface and a pair of opposing side section, a plurality of drainage openings are disposed along a lower portion of one side section, and a drainage hose is secured thereon. One or more guide tracks and moisture diverters are positioned along the length of the main body and secured thereto via one or more support plates. One or more gaps are positioned between the guide tracks and moisture diverters.

12 Claims, 6 Drawing Sheets

CONCEALED SLIDING PARTITION TRACK AND INTEGRATED SUBTERRANEAN WATER REMOVAL SYSTEM

CROSS-REFERENCE TO RELATED APPLICATIONS

This application claims the benefit of U.S. Application Ser. No. 61/527,279 filed on 25 Aug. 2011, the contents of which are incorporated herein by reference. This application is filed in accordance with MPEP §710.05.

BACKGROUND

Field of the Invention

The present invention relates generally to sliding panel systems, and more particularly to a lift and slide track partition system having an integrated water removal feature.

Many new homes are now constructed with large outdoor living areas. These areas often include tile floors and other accompaniments so as to allow a more seamless flow between the outside area and an adjoining interior space.

As is known in the art, these spaces are typically separated by a partition and/or sliding door which allows the user the ability to create a combined indoor/outdoor space when desired. There are many known tracks for operating the partition. Many of these tracks are designed to rest above the flat surface of the flooring separating the inside space and the outside space in order to act as a dam for preventing water from entering the building. Unfortunately, these devices suffer from several major drawbacks. To this end, the presence of the above ground track systems is not aesthetically pleasing, and they can ruin the otherwise seamless transition from indoor to outdoor space. Additionally, owing to the large above surface footprint, it is not uncommon for people to trip on the track, thus causing injuries and/or embarrassment.

Accordingly, there remains a need for a concealed sliding partition track and integrated subterranean water removal system that does not suffer from the drawbacks of the devices described above.

SUMMARY OF THE INVENTION

The present invention is directed to a concealed sliding partition track and integrated subterranean water removal system.

One embodiment of the present invention can include an elongated generally U shaped main body having an angled top surface for directing water towards a plurality of openings disposed along a lower portion of a side section. One or more guide tracks and moisture diverters can be disposed along the length of the main body and secured thereon via support plates. Gaps between the guide tracks and moisture diverters route water to the main body for removal via the openings and a plurality of drain hoses.

In another embodiment, each of the support plates further includes a plurality of grooves disposed along the bottom section for allowing water to flow across the entirety of the main body.

Yet another embodiment of the present invention can include drain pan positioned beneath the main body, said drain pan being configured to receive the water and deposit the same into the surrounding ground via a plurality of openings disposed on a bottom section thereof.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
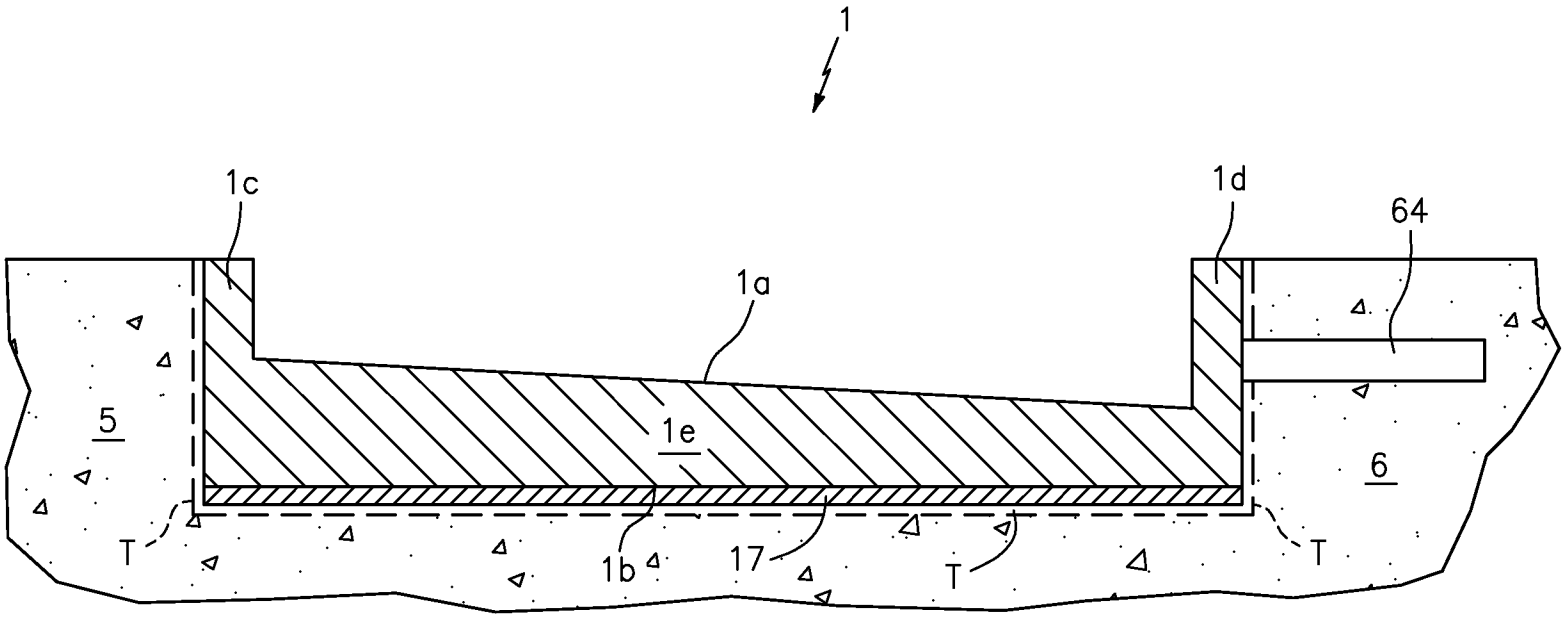
FIG. 1*a* is a side view of the main body of a concealed sliding partition track and integrated subterranean water removal system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described throughout this document, a concealed sliding partition track system with integrated subterranean water removal feature can be utilized in conjunction with a sliding partition (such as a sliding glass door, for example), to provide access to outside living spaces (e.g., patios, sunrooms, lanai's, etc.). The system can act to providing a seamless transition along the flooring between the inside space and the outside space, while simultaneously preventing moisture from entering the interior space. Although illustrated as a means for positioning sliding doors, one of skill in the art will recognize that the inventive concepts disclosed herein can be utilized for a wide variety of sliding partitions such as sliding shutters, sliding windows and/or sliding hurricane doors and windows, among many others.

A concealed sliding partition track system with integrated subterranean water removal feature 100 can preferably be installed under a finished floor so as to be concealed by the flooring on both the inside space and the outside space. The track system can preferably include a series of channels, the exact number of which will depend on the number of panels needed to span the width of the opening between the inside and outdoor space. As will be described below, the main body can act as a subterranean reservoir for capturing water and positioning a track running parallel and slightly above the floor for the door to roll on. The track system can act to channel water to the reservoir which then releases the same to the ground through a series of drainage ports.

Figure 1B:
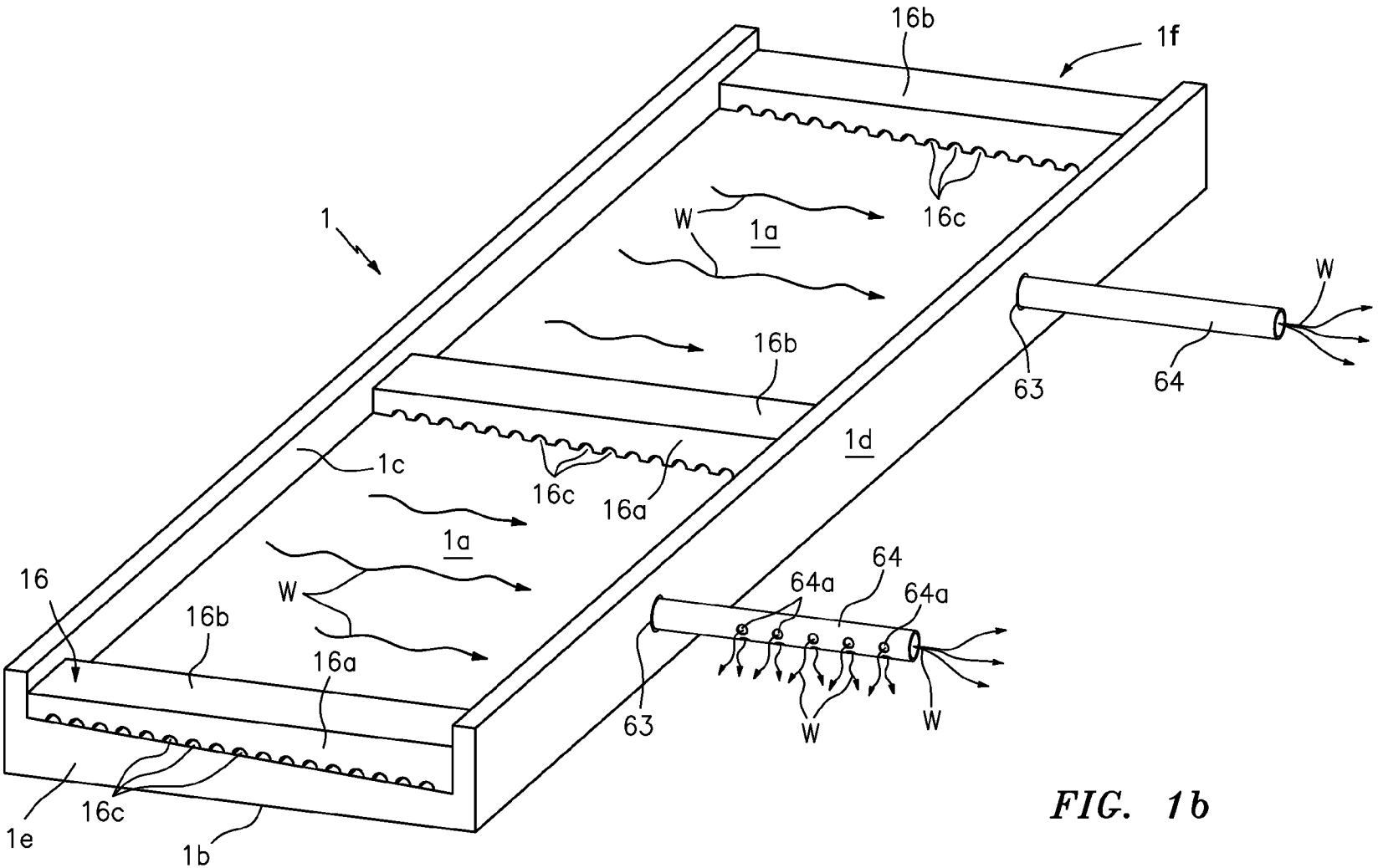
FIG. 1*b* is a perspective view of the main body of a concealed sliding partition track and integrated subterranean water removal system that is useful for understanding the inventive concepts disclosed herein.

FIGS. 1*a* and 1*b* illustrate one embodiment of the main body 1 for use with the system 100. As shown, the main body 1 can include an elongated generally U-shaped construction for resting atop a level foundation support plate 17. The main body 1 can be disposed within a trench/opening T cut into the ground at a location separating the inside space 5 from the outside space 6 (i.e., threshold opening). The main body 1 can act as both a frame for supporting the track and partitions, as well as a reservoir for collecting and removing water from the system. To this end, the generally U-shaped main body 1 can include a sloped/angled top surface 1*a*, a generally planar bottom surface 1*b*, a pair of opposing side surfaces 1*c* and 1*d*, and a pair of opposing end surfaces 1*e* and 1*f*. Although described herein as separate elements, other embodiments wherein the support plate 17 is integrated into the construction of the main body 1 are contemplated.

As shown, the side surface 1*c* can be positioned adjacent to the interior space 5, and the opposing side surface 1*d* can be positioned adjacent to the exterior space 6. To this end, the top surface 1*a* can be angled so as to allow water W to flow downward from surface 1*c* towards 1*d*, and away from the inside space. Side surface 1*d* can include one or more drain openings 63, each of which being further connected to a drainage hose 64 for removing water from the system, and allowing the removed water to be absorbed into the ground. In one alternate embodiment, one or more of the drain hoses 64 can further include a plurality of small openings 64*a* disposed along the length thereof, so as to allow water to drain evenly over a larger surface area. The arrangement of the above described components allows the main body 1 to effectively function as a reservoir for removing any water from the system, and away from the interior space of the building.

The main body 1 will be sized to accommodate the length and width of the threshold opening T which separates the inside 5 and outside 6 spaces. The width will be based on the number of sliding doors 35 needed to span the threshold. In one preferred embodiment, the main body 1 can be constructed from a hardened waterproof material such as cast aluminum or stainless steel. However other materials such as high density plastic, polyvinyl chloride, polyethylene or composite material, for example, can also be utilized. Additionally, each drainage hose 64 can preferably be constructed from a waterproof material such as polypropylene and include an anti bacterial coating that is adhered to the inside of the hose at a time of manufacturer, in accordance with known manufacturing processes. Of course, any number of other construction materials and methodologies are also contemplated.

As shown best in FIG. 1*b*, one or more track supports 16 can be positioned onto the top surface of the main body 1*a* and can be adjoined to each of the opposing side surfaces 1*c* and 1*d*, respectively. As shown, each of the track supports 16 can include angled side sections 16*a* which are complementary to the sloped top surface 1*a* so as to position the top surface 16*b* in a generally flat and level manner. Additionally, the bottom section of each of the track supports 16 can further include a plurality of grooves/corrugations 16*c* running in-line with the length of the main body. Each of these corrugations being configured to allow water to flow evenly throughout the top surface 1*a* of the main body, in order to allow for even water removal via the drain hoses 64, and to prevent any portion of the system from becoming flooded.

Owing to the sloped design of the main body 1, the system allows for expedited channeling of any moisture or water toward the drainage ports 63. Access to the ports 63 is unobstructed as the corrugated sloped track support 16 allows water to freely pass through the corrugated ribs 16*b*, and into the ports 63.

While the dimensions of the elements are not critical, in the preferred embodiment the upper surface 1*a* of the main body can include an angle of between 5 and 45 degrees with respect to a flat level horizontal surface.

Figure 2:
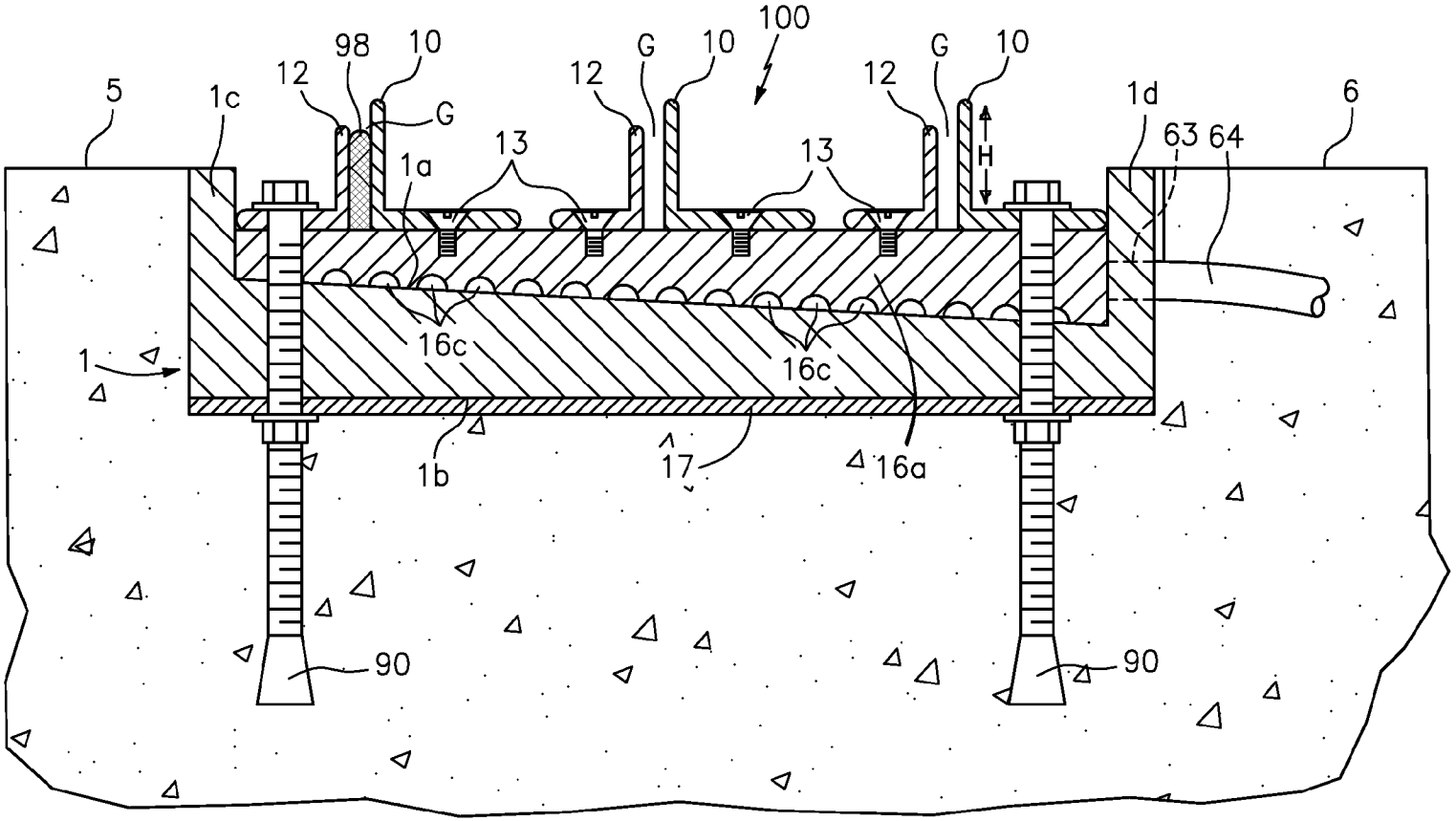
FIG. 2 is a side view of the concealed sliding partition track and integrated subterranean water removal system, in accordance with one embodiment of the invention.
Figure 3:
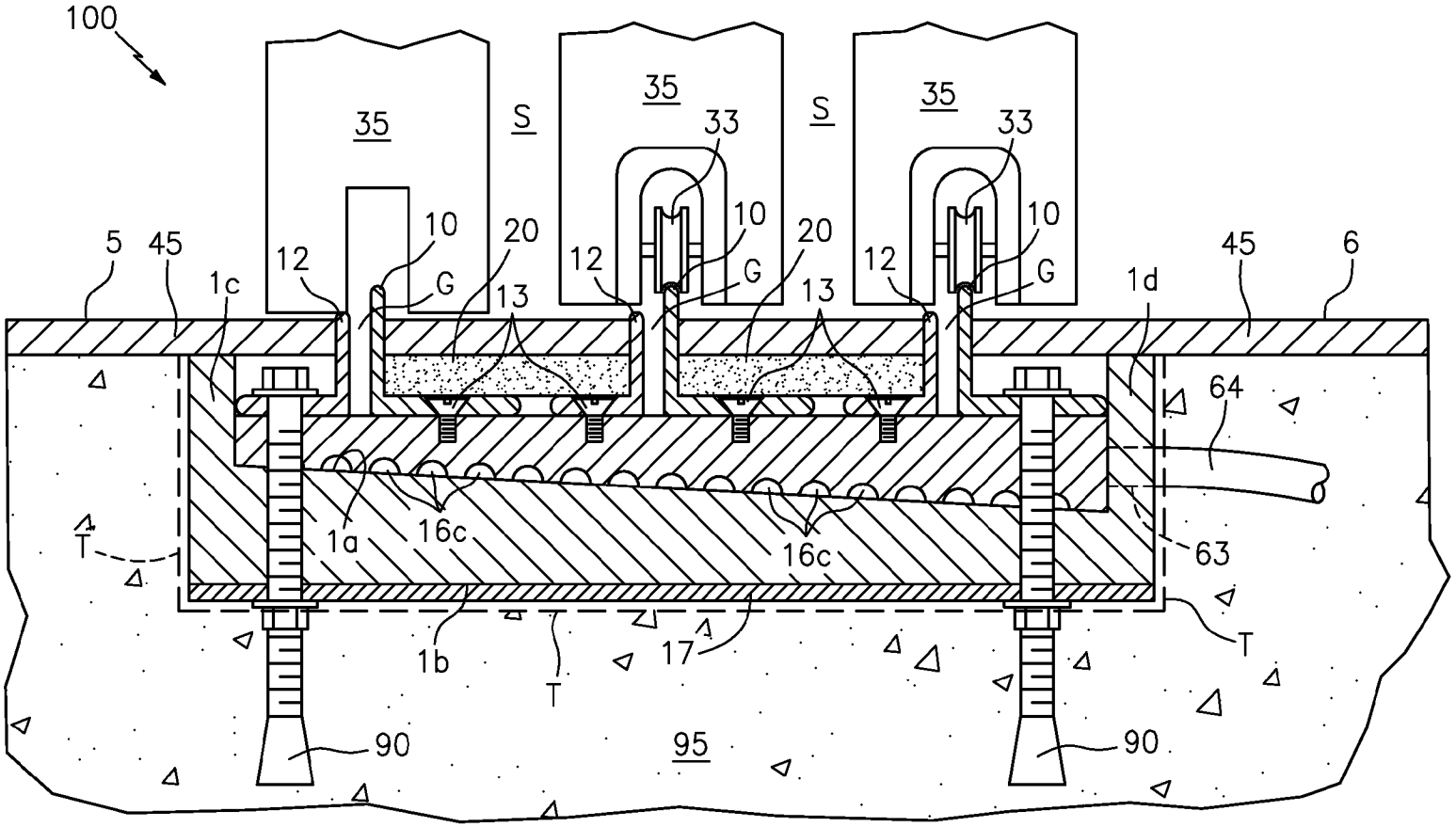
FIG. 3 is another side view of the concealed sliding partition track and integrated subterranean water removal system, in accordance with one embodiment of the invention.
Figure 4:
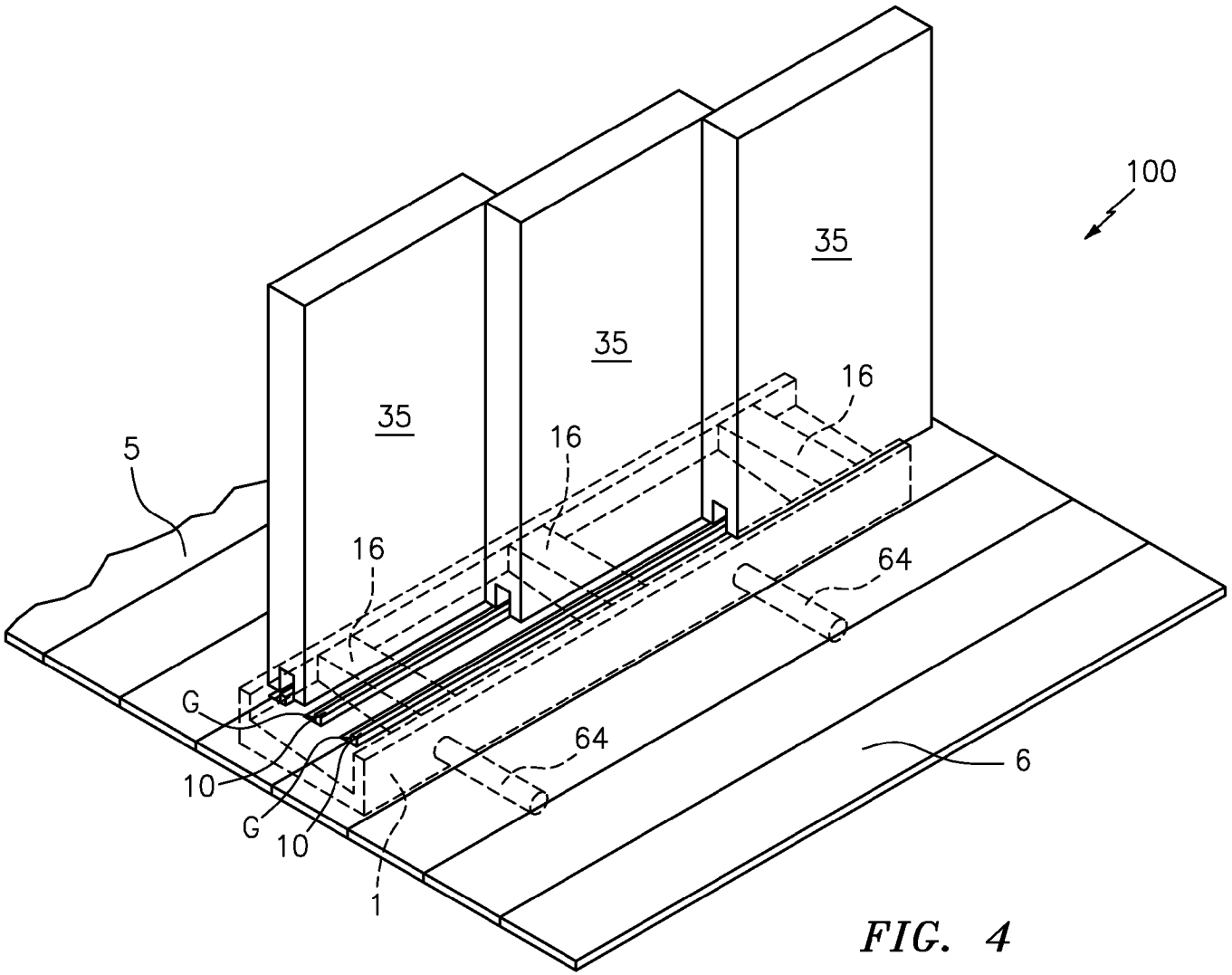
FIG. 4 is a perspective view of the concealed sliding partition track and integrated subterranean water removal system, in operation, and in accordance with one embodiment of the invention.

FIGS. 2-4 illustrate one embodiment of a concealed sliding partition track and integrated subterranean water removal system 100 utilizing the main body 1, described above. As shown, the system can further include a plurality of generally L shaped roller guide tracks 10 that are positioned along the length of the main body 1 in a parallel orientation to the side sections 1*c* and 1*d*. The glide tracks 10 can be secured to the top of the track supports 16 so as to remain suspended above the top surface of the main body 1*a* in all locations where the supports are not present.

In one preferred embodiment, each guide track 10 can be constructed from a hardened metallic material having a dimension suitable for extending approximately 3/16 of an inch above the finished flooring 45, in order to allow a sliding panel 35 to travel along the track via wheels 33. Each of the guide tracks 10 can be positioned along the main body so as to leave a space S for accommodating multiple sliding doors 35 in a conventional manner, wherein each door can slide along the track independently of another.

A series of generally backward "L"-shaped moisture diverters 12 can be positioned adjacent to each of the roller guide tracks 10 in such a way as to leave a uniform gap G between the tracks 10 and the diverters 12. As shown, the diverters can be slightly shorter than the guide tracks 10 so as to allow any water encountered by the system to flow over the top of the diverters 12 and into the reservoir 1 via the gaps G. In one preferred embodiment, the diverters 12 will have a top surface that is generally flush with the top of the floor 45, although in some embodiments, the diverter 12 may be slightly above floor level. As shown, one or more optional filters 98 such as wire mesh, for example, can be placed over the gap G in order to prevent any debris from entering the reservoir.

In one non-limiting example, the roller guide track 10 and moisture diverter 12 can be fastened to track supports 16 system utilizing 1/4"×5/8" machine screws 13. Of course any number of known hardware and/or additional construction techniques can also be utilized.

Although illustrated as including a series of three track supports, the invention is not limited to this arrangement. As is known to one of skill in the art, the number of tracks 10, and accompanying diverters will vary depending on the overall length and number of independently moveable partitions 35.

To this end, the system 100 as illustrated includes three tracks and associated hardware, but the invention is not limited to this configuration. Moreover, alternate embodiments are also contemplated wherein the moisture diverter 12 is located on opposite sides of the track 10.

As best shown in FIG. 3, the system 100 can be deposited within a threshold opening T and secured to the ground 95 (preferably a concrete substrate) utilizing traditional mounting hardware such as a ⅜"×5" adjustable wedge anchor 90, for example. As shown, the anchors 90 can preferably be mounted through the outermost track 10 and/or diverter 12 that is located closest to opposing side walls 1*c* and 1*d*. The anchors 90 will act to securely position the system 100 to the ground 95 within the opening T in a permanent manner that is level with the finished flooring 45, in accordance with known construction techniques.

Conventional grout and/or grout plates 20 can be positioned between each roller guide 10 and moisture diverter 12 so as to provide firm level support for the finished flooring to be installed. To this end, upon successful installation, the system 100, with the exception of the uppermost edge of the tracks 10 can be covered by the finished floor surface 45 utilizing conventional construction methodologies.

To this end, the system can be incorporated into the construction of new buildings such as homes and/or offices, for example and installed prior to the finished carpet or tile installation. Such a feature can allow for a customized look wherein the appearance of the system 100 is virtually invisible to a user. Alternatively, the system 100 can be used with existing structures wherein the trench is cut, the system installed, and then tile or carpet is secured over the system.

As shown, each track 10 can include a height H sufficient be engaged by the undercarriage wheels 33 of a conventional sliding panel 35. The sliding panel 35 partition can be constructed of materials manufactured from a combination or singularly of wood, plastic, fiberglass, metal and or glass which in turn form the panel 35 unit. The manufacturing and operation of sliding panels are well known to those of skill in the art; therefore no further description will be provided herein.

Figure 5:
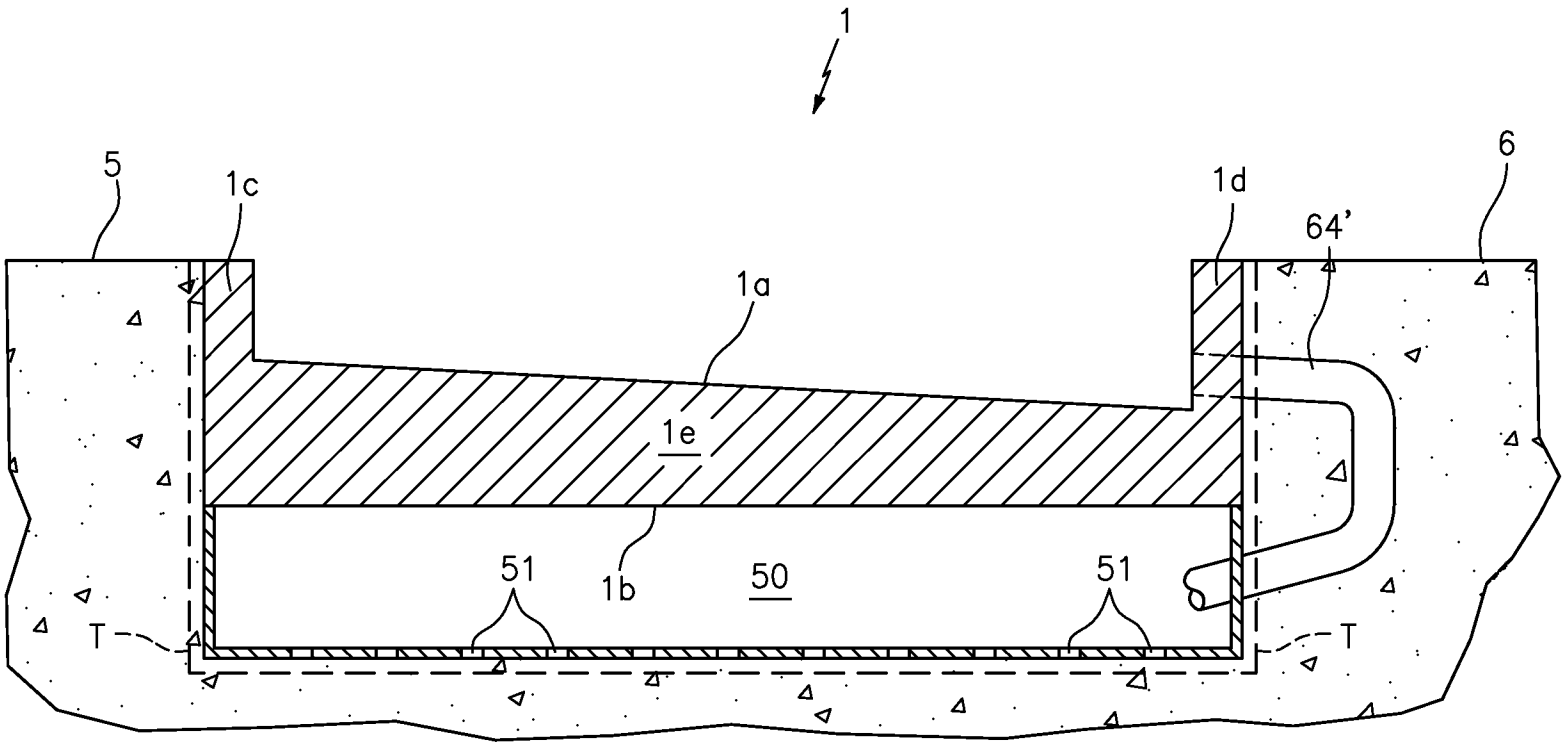
FIG. 5 is a partial side view of the concealed sliding partition track and integrated subterranean water removal system, in accordance with an alternate embodiment.

FIG. 5 illustrates an alternate embodiment of the system 100 that further includes an elongated, generally rectangular drain pan 50 positioned beneath the main body 1 into which excess water runoff can be placed. As shown, a curved drain hose 64' can act to funnel any water down and into the drain pan. Additionally, a plurality of optional holes 51 positioned along the bottom surface of the drain pan 50 so as to allow any water contained therein to be absorbed into the ground. In one preferred embodiment, the drain pan 50 can run the entire length of the main body 1; however other embodiments wherein the drain pan has a different length than the main body are also anticipated.

As described herein, one or more elements of the concealed sliding partition track and integrated subterranean water removal system 100 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 1, the track support 16, support plate 17, guide 10 and/or diverter 12, for example, may be formed together as one continuous element, either through manufacturing processes, such as welding, casting, or molding, or through the use of a singular piece of material milled or machined with the aforementioned components forming identifiable sections thereof. Moreover, it is preferred that each of the main body 1, track 10, diverter 12, corrugated track support 16 and/or the foundation support plate 17 be constructed from a hardened waterproof material such as cast aluminum or stainless steel. However other materials such as high density plastic, polyvinyl chloride, polyethylene or composite material, for example, can also be utilized.

A method for installing a concealed sliding partition track and integrated subterranean water removal system, such as the system 100 described above, for example is now disclosed. The method can begin with the track system assembly and/or fabrication based on the desired number of panels and the length of the threshold opening.

Next, the installation of the adjustable anchor 90 can be accomplished by using one or more predrilled holes in the roller guide track 10 and moisture diverter 12 as a template for drilling into the concrete substrate 95 with the appropriate bit sized to accommodate the approved anchor 90.

Next, one or more foundation support plates 17 can be placed into the desired location and leveled utilizing known methodologies and equipment such as, for example, leveling nuts, and/or washers (not illustrated).

After leveling the support plates 17, the main body 1 can be installed, as described above. Additionally, one or more grout plates 20 can be laid in between each roller guide 10 and moisture diverter 12.

Finally, flooring 45 such as tile or carpet, for example, can be laid across the system 100. To this end, only the uppermost portion of the guide track(s) 10 will protrude up through the finished flooring, and the flooring will not cover the gaps G. Gaps G will function, as described above, to allow water to be removed from the system in a direction away from the interior space 5.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A concealed sliding partition track and integrated subterranean water removal system, comprising:

an elongated generally U shaped main body having a planar bottom surface, opposing first and second side sections, an angled top surface configured to divert water from the first side section to the second side section, and a plurality of drain openings disposed along the second side section, each of the drain openings having a drain hose secured thereto, said openings and hoses being configured to evacuate water from the system and into a surrounding ground;

a plurality of support tracks disposed along the upper surface of the main body, each of said support tracks including a generally flat-level upper surface, a pair of side sections having a complementary angle to the top surface of the main body, and a bottom section abutting the top surface of the main body, and a plurality of grooves disposed along the bottom section of each of the plurality of support tracks, said grooves being configured to allow water to flow across the entirety of the main body;

one or more roller guide tracks disposed along a length of the main body, each of the guide tracks comprising a generally L shaped member having a bottom surface secured to the plurality of support tracks, and a top surface configured to receive a sliding partition;

one or more moisture diverters disposed along the length of the main body adjacent to each of the one or more roller guide tracks, said moisture diverters including a height that is less than a height of the one or more roller guide tracks; and a gap disposed between the one or more roller guide tracks and the one or more moisture diverters, along the length of the main body, said gap being configured to allow water to drain into the main body.

2. The system of claim 1, wherein the main body is configured to be installed into a threshold opening having the first side section located adjacent to an interior space, and the second side section adjacent to an exterior space, and the drain openings and drain hoses are configured to divert water away from the inside space.

3. The system of claim 2, wherein the height of the moisture diverter is level with a height of a finished floor spanning both the interior space and the exterior space.

4. The system of claim 1, further comprising:

a screen disposed within the gap, said screen being configured to prevent debris from entering the main body.

5. The system of claim 1, further comprising:

an elongated support plate secured to the bottom of the main body.

6. The system of claim 1, wherein the drain hose further includes plurality of openings disposed along the entirety of the hose, each of said openings being configured to expel water across a greater area of ground.

7. The system of claim 6, wherein the drain hose further includes an anti bacterial coating.

8. The system of claim 1, wherein the drain hose further includes an anti bacterial coating.

9. The system of claim 1, further comprising one or more grout plates disposed between the guide tracks and the moisture diverters.

10. The system of claim 1, further comprising:

a moveable partition disposed onto each of the one or more guide tracks.

11. A concealed sliding partition track and integrated subterranean water removal system, comprising:

an elongated generally U shaped main body having a planar bottom surface, opposing first and second side sections, an angled top surface configured to divert water from the first side section to the second side section, and a plurality of drain openings disposed along the second side section;

an elongated generally rectangular drain pan having a top surface that is secured to the bottom surface of the main body;

a plurality of drain hoses secured to each of the main body and the drain pan, said drain hoses being configured to transfer water from the main body into the drain pan;

a plurality of support tracks disposed along the upper surface of the main body, each of said support tracks including a generally flat-level upper surface, a pair of side sections having a complementary angle to the top surface of the main body, and a bottom section abutting the top surface of the main body, and a plurality of grooves disposed along the bottom section of each of the plurality of support tracks, said grooves being configured to allow water to flow across the entirety of the main body;

one or more roller guide tracks disposed along a length of the main body, each of the guide tracks comprising a generally L shaped member having a bottom surface secured to the plurality of support tracks, and a top surface configured to receive a sliding partition;

one or more moisture diverters disposed along the length of the main body adjacent to each of the one or more roller guide tracks, said moisture diverters including a height that is less than a height of the one or more roller guide tracks; and a gap disposed between the one or more roller guide tracks and the one or more moisture diverters, along the length of the main body, said gap being configured to allow water to drain into the main body.

12. The system of claim 11, further comprising:

a plurality of openings disposed along a bottom surface of the drain pan, each of said openings being configured to expel water into a ground area surrounding the drain pan.

* * * * *